United States Patent [19]

McAneny

[11] Patent Number: 4,629,438

[45] Date of Patent: Dec. 16, 1986

[54] RUBBER BAND POWERED MOTOR FOR MODEL AIRPLANE

[76] Inventor: Leonard G. McAneny, 455 Garfield Ave., Mineola, N.Y. 11501

[21] Appl. No.: 766,894

[22] Filed: Aug. 16, 1985

[51] Int. Cl.[4] ..... A63H 27/02

[52] U.S. Cl. ..... 446/58; 446/59; 185/10; 185/39; 185/DIG. 1

[58] Field of Search ..... 446/57, 58, 59, 60; 185/10, 39, DIG. 1

[56] References Cited

U.S. PATENT DOCUMENTS

| | | | |
|---|---|---|---|
| 1,365,917 | 1/1921 | Hutchinson . | |
| 1,440,126 | 12/1922 | Aust | 185/39 X |
| 1,682,267 | 8/1928 | Daniel . | |
| 1,795,165 | 3/1931 | Daniel | 446/58 |
| 1,928,154 | 9/1933 | Hojnowski | 446/58 X |
| 1,936,072 | 11/1933 | Roderick . | |
| 2,098,019 | 11/1937 | Weimerskirch . | |
| 2,437,743 | 3/1948 | Hojnowski | 446/58 |
| 4,318,455 | 3/1982 | Lapierre . | |

FOREIGN PATENT DOCUMENTS

| | | | |
|---|---|---|---|
| 421996 | 3/1911 | France | 446/59 |

*Primary Examiner*—F. Barry Shay

*Attorney, Agent, or Firm*—Brumbaugh, Graves, Donohue & Raymond

[57] ABSTRACT

A rubber band powered motor for a model airplane is provided having dual parallel drive shafts from which perpendicularly extend through the wing portions of the plane rubber band motor units, which comprise tape rollers, non-elastic tapes, guide rollers and rubber bands. The drive shafts extend through and are fixed to the tape rollers, upon which is wound the non-elastic tapes. The rubber bands are guided around the guide rollers and are connected to the tapes at one end and to the airframe at the other. Gear means are wound to rotate the shafts to wind the tapes so as to stretch the rubber bands. In operation, the bands relax and pull the tapes to turn the shafts and, via an intermediate gear drive train, the propeller. The tapes and gears absorb the sudden burst of rubber band energy and provide for an extended and stable flight.

6 Claims, 3 Drawing Figures

RUBBER BAND POWERED MOTOR FOR MODEL AIRPLANE

FIELD OF THE INVENTION

The present invention relates to flying model airplanes and the like and, more specifically, to a rubber band powered motor for such airplanes.

BACKGROUND OF THE INVENTION

Flying model airplanes, such as of the type utilizing rubber bands as the source of power for propulsion, generally consist of an airframe having a geometrical arrangement to produce lift, typically including a central body, wings and a tail. To ensure longitudinal stability, most planes employ tails which are approximately one third the area of the wings, contain long noses to compensate for the weight of the engine, and provide wings that slope upwards from root to tip.

Because the craft is powered by rubber, which inherently has potentially less endurance in flight than an internal combustion engine, it is necessary to extend the available power over as long a period of time as possible. Wide blades are sometimes used to absorb and slow the unwinding of the tightly wound rubber. Other prior art crafts have implemented a plurality of rubber bands to increase and prolong power.

For example, U.S. Pat. No. 1,682,267 to Daniel is directed to a toy airplane having two rubber bands suspended at opposite sides of the longitudinal center of the body of the toy. The endless elastic bands are suspended at one end from hooks attached to the rear ends of driven shafts. The bands are suspended at the other end from hooks attached to the front ends of power shafts, which contain pinions and a gear wheel. A crank is turned to twist the rubber bands which store the power to operate the driving shafts and gears so as to rotate the propeller shaft and the air propeller.

U.S. Pat. No. 1,936,072 to Roderick similarly provides a plurality of rubber bands to power a model aircraft. Two driving units operate successively to double the period of time of motor operation.

Other similar free-flying rubber band powered toy airplanes are disclosed in U.S. Pat. No. 1,365,917 to Hutchinson, U.S. Pat. No. 2,098,019 to Weimerskirch, and U.S. Pat. No. 4,318,455 to Lapierre.

All of these devices are subject to the inherent flaws of the longitudinally positioned twisted rubber band: imbalance and unpredictability.

SUMMARY OF THE INVENTION

Accordingly, it is a primary object of the present invention to provide a rubber band powered motor for a model airplane which is not subject to the foregoing deficiencies.

Other objects are to provide such a durable airplane which runs quietly, is lightweight, has increased motor power and flight time, and is easy to use.

These objects are attained, in accordance with the present invention, by providing a rubber band powered motor for a model airplane which includes dual drive shafts positioned in parallel within the central body of the plane. Each drive shaft has a front end and rear end associated with the front and rear end of the air frame, respectively. Rubber band motor units are provided for propulsion power and extend from and perpendicular to the drive shafts, with one or more separate motor units being provided for each shaft. The positioning of the shafts and rubber band motor units ensures that the propeller will receive energy stored in both sides of the aircraft in substantially equal amounts. Front gear trains connect the drive shafts to the propeller and rear gear trains provide a positive cranking drive to the drive shafts for winding of the motor. Upon release, the rubber bands cause the front gear trains to incrementally turn the propeller, thereby accelerating the airplane into and through the air.

Preferably, the rubber band motor units each comprise a plurality of tape rollers having a centrally located bore through which the associated drive shaft extends. Non-elastic tapes, each having a securing hook attached to the exposed end thereof, are wound around the tape rollers to provide the craft with means to, in conjunction with the gears, absorb and slow the relaxation of the tightly stretched rubber bands. Holding shafts, preferably positioned near the wing tips, secure a plurality of rubber band guiding rollers. The bands pass around the guide rollers and are removably secured at one end to the securing hook of the non-elastic tape and at the other end to a hook fixedly attached to the airframe.

In operation, the rear gear trains are turned to rotate the drive shafts and tape rollers and thereby wind the tapes to stretch the rubber bands. When released, the rubber bands relax and pull the tapes. The front gear trains turn the propeller to accelerate the airplane into and through the air with stability and efficiency.

BRIEF DESCRIPTION OF THE DRAWINGS

The foregoing and other objects, features, and advantages will become apparent and a better understanding will result from the following detailed description of the invention, from the claims and from the drawings, of which

DETAILED DESCRIPTION OF THE PREFERRED EMBODIMENT

Figure 1:
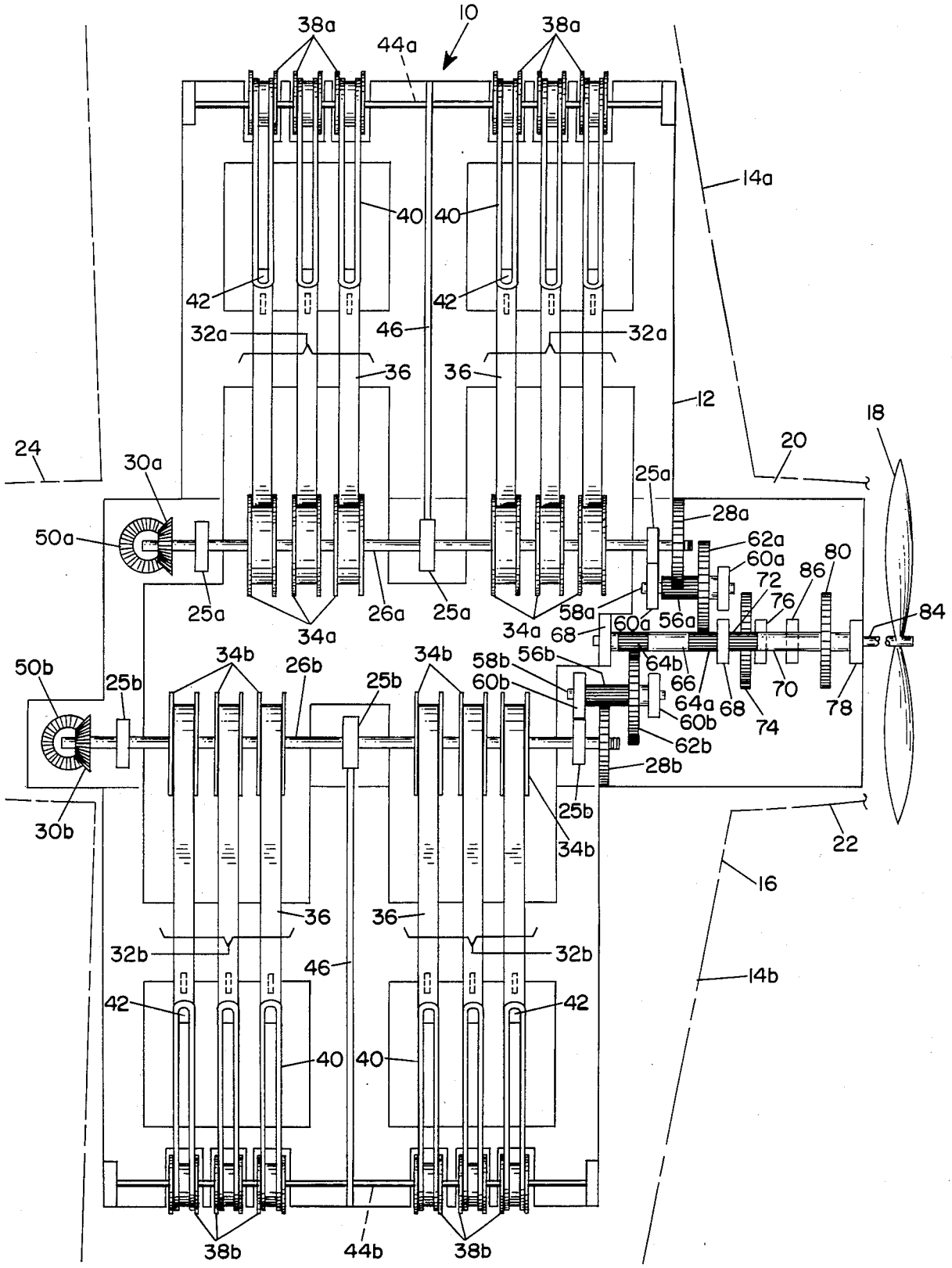
FIG. 1 is a top plan view of the rubber band powered motor of the present invention.

While this invention is susceptible of embodiment in many different forms, there is shown in the drawings and will herein be described in detail one specific embodiment, with the understanding that the present disclosure is to be considered as an example of the principles of the invention and is not intended to limit the invention to the embodiment illustrated.

Referring particularly to FIG. 1, there is shown a rubber band powered motor 10 within a lightweight framework 12, which preferably is sized to fit securely within the wings 14*a*, 14*b* of a model airplane 16. The outline of the airplane 16 is shown in phantom lines for clarity of illustration of the details of the motor 10. In FIG. 1, the airplane 16 contains the conventional features of a free-flying model airplane in that it has a propeller 18, a central body 20, a front end 22, a rear end 24 and wings 14*a*, 14*b*.

As mentioned earlier, the body of a conventional craft would also typically contain a tail (not shown) approximately one-third the area of the wings 14*a*, 14*b*. Further, the craft would preferably be designed to compensate for the weight of the engine. These features, however, are not the subject of the present invention and can be achieved by means well known in the art.

As best seen in FIG. 1, first and second drive shafts 26*a*, 26*b* are placed in parallel within the central body 20 to balance the craft and to provide driving movement. Vertically extending supports 25*a*, 25*b* are provided at the front, middle and rear of the shafts 26*a*, 26*b* (see also FIG. 2) to journal the shafts. Each drive shaft 26*a*, 26*b* carries at its front end ratchets 28*a*, 28*b* and at its rear end a bevel gear 30*a*, 30*b*.

Figure 3:
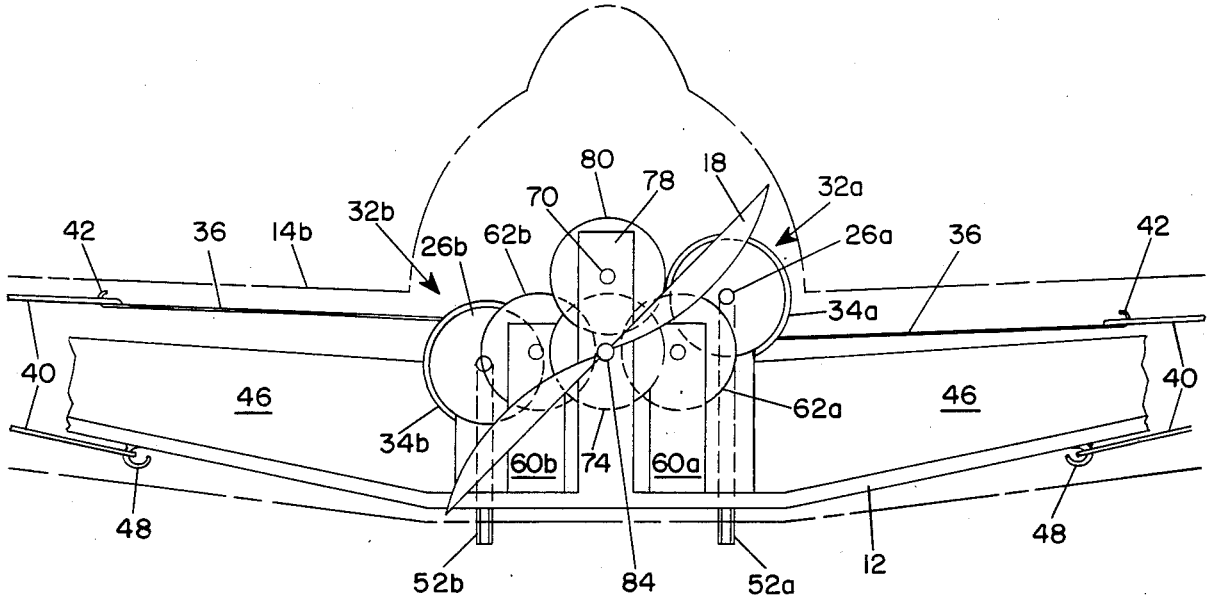
FIG. 3 is a front view of the rubber band powered motor of the present invention.

In contrast to prior art systems which employ rubber band power that is longitudinally placed through the body of the aircraft, the present invention employs rubber band motor units 32*a*, 32*b* which extend perpendicular to the drive shafts 26*a*, 26*b*, so that the propeller 18 receives energy stored in both sides of the aircraft in substantially equal amounts. This ensures maximum stability for the craft upon takeoff and through the air. Preferably, each rubber band motor 32*a*, 32*b* unit is sized and arranged to extend within a wing 14*a*, 14*b* of the airplane, as illustrated in FIG. 3. Alternatively, the motor units may lie beneath the wings.

Each rubber band motor unit 32*a*, 32*b* preferably includes one or more tape rollers 34*a*, 34*b*, non-elastic tapes 36, guide rollers 38*a*, 38*b*, and rubber bands 40. Two motor units 32*a*, 32*b* of three rollers 34*a*, 34*b*, etc. each are shown in FIG. 1, but it will be understood that this is for illustrative purposes and that both the number of units and the number of components (rollers, etc.) within sets may be varied as desired. For maximum stability, however, the number of units and components thereof should be symmetrical on both sides of the drive shafts.

The rollers 34*a*, 34*b* are keyed or otherwise fastened to the drive shafts 26*a*, 26*b* for rotation therewith. The nonelastic tapes 36 are fixed at one end to the rollers 34*a*, 34*b* and are wound thereon, with the free ends thereof carrying hooks 42 for engagement with the associated rubber bands 40. The tapes absorb and slow the sudden relaxation of the tightly stretched rubber bands 40 as will be explained later.

The guide rollers 38*a*, 38*b* are rotatably supported by holding shafts 44*a*, 44*b* located at the opposite ends of the framework 12. Preferably, a transverse reinforcing rib 46 is provided to lend rigidity to the framework 12 and to retain the holding shafts 44*a*, 44*b* in position as the motor is wound. The rubber bands are removably secured at one end to the hooks 42 carried by the tapes 36, pass around the guide rollers 38*a*, 38*b*, and are secured at the other end to hooks 48 fixedly attached to the framework 12 (see FIG. 3). As illustrated, the rubber bands 40 are of the continuous loop type and are looped over the hooks 42 and 48. Other types of rubber bands may be used if desired.

Turning now to the mechanism for winding the motor 10, the bevel gears 30*a*, 30*b* at the rear ends of the drive shafts 26*a*, 26*b* engage respective bevel gears 50*a*, 50*b* that are carried by vertical shafts 52*a*, 52*b*. At the lower ends, the shafts 52*a*, 52*b* are shaped for receipt of a winding crank or wrench 52. To wind the rubber band motor units 32*a*, 32*b*, the crank 54 is rotated in a counter-clockwise direction, so as to rotate drive shaft 26*a* outwardly and the drive shaft 26*b* inwardly. Thus, as seen in FIG. 3, the non-elastic tapes 36 associated with motor unit 32*a* wind under the tape rollers 34*a* and the nonelastic tapes 36 associated with the motor unit 32*b* wind over the tape rollers 34*b*. For either shaft, such winding stretches the rubber bands 40 around the guide rollers. Becuase the bands 40 are not twisted, a more balanced takeoff and a straighter flight results. The propeller 18 may simply be held against rotation by either holding the propeller 18 or inserting between the blades of the propeller into a hole (not shown) in the front end of central body 20 a peg (not shown) until the winding of both shafts 26*a*, 26*b* has been completed.

Figure 2:
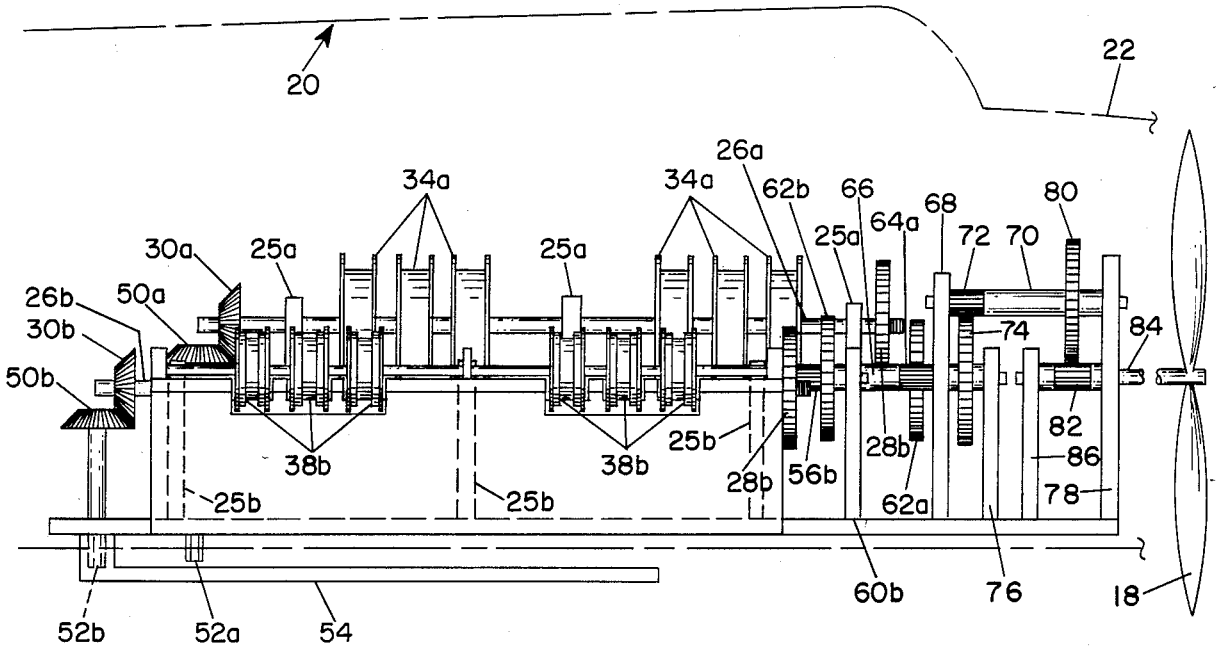
FIG. 2 is a side view of the rubber band powered motor of the present invention.

The propeller 18 is connected to the drive shafts 26*a*, 26*b* through a series of interconnecting ratchet and pinion gears. Thus the ratchets 28*a*, 28*b* carried by the shafts 26*a*, 26*b* engage pinions 56*a*, 57*b*, which in turn are carried by shafts 58*a*, 58*b* journalled in the vertical supports 60*a*, 60*b*. Forward of the pinions 56*a*, 56*b*, the shafts 58*a*, 58*b* carry spur gears 62*a*, 62*b*, and these gears coact with pinions 62*a*, 64*b* on a common shaft 66. The shaft 66 is journalled in vertical supports 68. As best seen in FIG. 2, the vertical support 68 also rotatably supports a second shaft 70 at a level above the shaft 66. The shaft 70 carries a pinion 72 which coacts with a spur gear 74 carried at the forward end of the shaft 66. Forward of the spur gear 74, the shaft 66 is supported by a vertical support 76. At its front end the upper shaft 70 is journalled in a vertical support 78 and, just rearwardly thereof, carries a spur gear 80. This gear 80 coacts with a pinion 82 carried by the propeller shaft 84, which as shown in FIG. 2 is rotatably supported by the vertical supports 78 and 86.

As will be apparent, therefore, the motive force from the opposed motor units 32*a*, 32*b* of rubber bands will be delivered through the drive shafts 26*a*, 26*b*, the ratchets 28*a*, 28*b*, the pinions 56*a*, 56*b*, the spur gears 62*a*, 62*b*, and the pinions 64*a*, 64*b* to the shaft 66. From the shaft 66, the force is transmitted via the spur gear 74 and pinion 72 to the upper shaft 70, and thence via the spur gear 80 and pinion 82 to the propeller shaft 84.

In operation, upon release of the propeller, as the case may be, the rubber bands 40 relax and pull the tapes 36 to turn the gears and the propeller 18. Because the tapes and gears absorb the sudden burst of rubber band energy, and because the rubber band motor units are perpendicular to and extend from the drive shafts, an extended and stable flight results.

Although the invention has been described and illustrated herein by reference to a specific embodiment thereof, it will be understood that such embodiment is susceptible to variation and modification without departing from the inventive concepts disclosed. All such variations and modifications, therefore, are intended to be included within the spirit and scope of the appended claims.

I claim:

1. A rubber band powered motor for a model airplane having a propeller and an airframe with a central body, a front end, a rear end, and wings extending from the central body, comprising:

first and second drive shafts mounted to said airframe and positioned in parallel relation within said central body, each drive shaft having a front end and a rear end associated with said front and rear ends of said air frame, respectively;

first and second rubber band motor means mounted to said airframe, extending from and perpendicular to said first and second drive shafts, respectively, on opposite sides thereof;

front gear means mounted to said airframe for connecting said drive shafts to said propeller; and rear gear means mounted to said airframe for providing a positive drive to said drive shafts for winding said rubber band motor means so as upon release of said shafts, to cause said front gear means to incrementally turn the propeller, thereby accelerating said airplane into and through the air.

2. The rubber band powered motor of claim 1 wherein said first and second rubber band motor means comprises:

first and second sets of tape rollers carried by said first and second drive shafts, respectively, with said drive shafts extending axially through said tape rollers;

first and second sets of non-elastic tapes wound around the rollers of said first and second sets of tape rollers, respectively, said tapes each having one end attached to a tape roller and a free end extending perpendicularly from said respective drive shaft;

first and second sets of guide rollers spaced along the wings of said airframe from said first and second drive shafts and corresponding in number to said tape rollers, the axes of said first and second guide rollers being parallel to said drive shafts; and first and second sets of rubber bands corresponding in number to said tape rollers, each rubber band being guided around one of said guide rollers and secured at one end to the free end of one of said non-elastic tapes and at the other end to said airframe.

3. The rubber band powered motor of claim 2 wherein the number of sets of tape rollers, non-elastic tapes, guide rollers, and rubber bands connected to each of said first and second drive shafts is equal.

4. The rubber band powered motor of claim 3 wherein there are two sets of tape rollers, non-elastic tapes, guide rollers, and rubber bands connected to each of said drive shafts.

5. The rubber band powered motor of claim 1 wherein said first and second rubber band motor means are located within the wings of said airframe.

6. The rubber band powered motor of claim 1 wherein said front gear means comprises:

first front gear means at said front end of said first drive shaft;

second front gear means at said front end of said second drive shaft;

a common propeller shaft for coacting with said first and second front gear means and for connecting said first and second front gear means to said propeller.

* * * * *